US010454180B2

(12) United States Patent
Kim et al.

(10) Patent No.: US 10,454,180 B2
(45) Date of Patent: Oct. 22, 2019

(54) ISOLATION BARRIER

(71) Applicant: RAYTHEON COMPANY, Waltham, MA (US)

(72) Inventors: Jacob Kim, Dallas, TX (US); Charles M. Rhoads, Mckinney, TX (US)

(73) Assignee: RAYTHEON COMPANY, Waltham, MA (US)

( * ) Notice: Subject to any disclaimer, the term of this patent is extended or adjusted under 35 U.S.C. 154(b) by 20 days.

(21) Appl. No.: 15/379,317

(22) Filed: Dec. 14, 2016

(65) Prior Publication Data

US 2018/0166791 A1 Jun. 14, 2018

(51) Int. Cl.
*H01Q 1/52* (2006.01)
*H01Q 17/00* (2006.01)
(Continued)

(52) U.S. Cl.
CPC ..... *H01Q 17/007* (2013.01); *H01Q 1/244* (2013.01); *H01Q 1/38* (2013.01); *H01Q 1/521* (2013.01);
(Continued)

(58) Field of Classification Search
CPC ..... H01Q 17/007; H01Q 1/38; H01Q 1/521; H01Q 17/004; H01Q 1/525; H01Q 1/244; H01Q 7/08; H01Q 21/30
See application file for complete search history.

(56) References Cited

U.S. PATENT DOCUMENTS 5,310,598 A * 5/1994 Yoshinaka ..... H01Q 17/002 342/1
7,164,933 B1 * 1/2007 Steigerwald ..... H01Q 1/243 455/129
(Continued)

FOREIGN PATENT DOCUMENTS

EP 1 962 377 A1 8/2008
JP S61-248626 A 11/1986
(Continued)

OTHER PUBLICATIONS

International Search Report for corresponding International Application No. PCT/US2017/056408, filed Oct. 12, 2017, International Search Report dated Jan. 10, 2017 and dated Jan. 17, 2017 (5 pgs.).
(Continued)

*Primary Examiner* — Dieu Hien T Duong
*Assistant Examiner* — Bamidele A Jegede
(74) *Attorney, Agent, or Firm* — Lewis Roca Rothgerber Christie LLP

(57) ABSTRACT

An isolation barrier for reducing coupling between a transmitting antenna on a platform and a receiving antenna on the same platform. The isolation barrier expands the isolation capabilities of radar absorbing material (RAM) to the low frequency region by integrating dielectric loaded corrugations with the RAM. The isolation barrier includes a plurality of corrugations, each including a channel with two conductive walls and a conductive base, having a depth greater than a quarter of the wavelength corresponding to the
(Continued)

low-frequency limit of the shared operating frequency band of the transmitting antenna and the receiving antenna. A layer of radar absorbing material (RAM) covers the corrugations.

17 Claims, 7 Drawing Sheets

(51) Int. Cl.
*H01Q 1/38* (2006.01)
*H01Q 7/08* (2006.01)
*H01Q 1/24* (2006.01)
*H01Q 21/30* (2006.01)

(52) U.S. Cl.
CPC ..... *H01Q 1/525* (2013.01); *H01Q 7/08* (2013.01); *H01Q 17/004* (2013.01); *H01Q 21/30* (2013.01)

(56) References Cited

U.S. PATENT DOCUMENTS

2001/0016254 A1* 8/2001 Mizuguchi ..... B29C 70/025 428/292.1
2005/0030218 A1* 2/2005 Kondo ..... H01Q 17/004 342/1
2006/0038736 A1* 2/2006 Hui ..... H01Q 1/243 343/835
2006/0238427 A1 10/2006 Ferguson et al.
2007/0069960 A1* 3/2007 Moon ..... H01Q 1/521 343/700 MS
2007/0285336 A1* 12/2007 Kamgaing ..... H01Q 1/2258 343/895
2008/0094302 A1* 4/2008 Murch ..... H01Q 1/48 343/846
2008/0204347 A1* 8/2008 Alvey ..... H01Q 1/52 343/841
2009/0153433 A1* 6/2009 Nagai ..... H01Q 1/38 343/893
2009/0315648 A1* 12/2009 Toyao ..... H01P 1/2005 333/238
2010/0214178 A1* 8/2010 Toyao ..... H01P 1/2005 343/702
2011/0012697 A1* 1/2011 Takemura ..... H01P 1/2005 333/212
2011/0170267 A1* 7/2011 Ando ..... H01Q 9/30 361/748
2012/0007786 A1* 1/2012 Ando ..... H01Q 9/0407 343/749
2012/0032865 A1* 2/2012 Toyao ..... H01P 1/2005 343/835
2012/0287000 A1* 11/2012 Ando ..... H01Q 9/0407 343/700 MS

FOREIGN PATENT DOCUMENTS

JP 2009-111463 A 5/2009
WO WO 2014/171993 A2 10/2014

OTHER PUBLICATIONS

Written Opinion of the International Searching Authority for corresponding International Application No. PCT/US2017/056408, filed Oct. 12, 2017, Written Opinion of the International Searching Authority dated Jan. 17, 2017 (7 pgs.).
Guohua, Zhang et al., "Using High Impedance Ground Plane for Radiation Improving in Microwave Antennas", IEEE, APMC Proceedings, 2005, 4 pages.
Kildal, Per-Simon, "Artificially Soft and Hard Surfaces in Electromagnetics", IEEE Transactions on Antennas and Propagation, Oct. 1990, vol. 38, No. 10, pp. 1537-1544.
Maqsood, M. et al., "Novel Multipath Mitigating Ground Planes for Multiband Global Navigation Satellite System Antennas", IEEE, 6th European Conference on Antennas and Propagation, 2011, pp. 1920-1924.

* cited by examiner

ISOLATION BARRIER

FIELD

One or more aspects of embodiments according to the present invention relate to radio frequency systems, and more particularly to a system for reducing interference between a transmitting antenna and a receiving antenna on the same platform.

BACKGROUND

Co-site interference for airborne and sea-based platforms which employ multiple radio frequency (RF) functions like electronic warfare, radar and communications may have an adverse performance effect on the on-board RF systems. For example, in a communications system, a transmitting antenna on one part of the exterior of a military or commercial vehicle may generate strong signals that may be received by a receiver, even if the main beam of the antenna is aimed well away from the receiving antenna on another part of the exterior of the vehicle. In cases in which the surface of the vehicle is metal, as may the case for a commercial or military aircraft, electromagnetic waves may propagate along the surface of the vehicle, potentially increasing the electromagnetic coupling between the transmitter and the receiver. Such signals can lead to substantial RF interference, receiver desensitization or performance degradation. This is especially true at lower frequencies (e.g., <4 GHz) where conventional radar absorbing material (RAM) isolation barriers become ineffective due to a limited barrier electrical size and material parameter roll-off (e.g., conventional magnetic RAM (MagRAM) magnetic loss properties).

Thus, there is a need for an improved system for isolating a receiving antenna from a transmitting antenna on the same platform, especially for low-frequency applications.

SUMMARY

Aspects of embodiments of the present disclosure are directed toward an isolation barrier for reducing coupling between a transmitting antenna on a platform and a receiving antenna on the same platform. The isolation barrier includes a plurality of corrugations, each including a channel with two conductive walls and a conductive base, having a depth greater than a quarter of the wavelength corresponding to the low-frequency limit of the shared operating frequency band of the transmitting antenna and the receiving antenna. A layer of radar absorbing material covers the corrugations.

According to an embodiment of the present invention there is provided a barrier for isolating a first antenna on a surface of a platform from a second antenna on the surface, the barrier including: a plurality of corrugations, each corrugation including a channel having two conductive walls and a conductive base, the channel extending in a direction parallel to the surface and perpendicular or oblique to a straight line between the first antenna and the second antenna; and a layer of radar-absorbing material on the corrugations.

In one embodiment, each corrugation has a depth of at least one quarter of a wavelength corresponding to a shared frequency of operation of the first antenna and the second antenna.

In one embodiment, the shared frequency of operation is at a low-frequency limit of the first antenna.

In one embodiment, the shared frequency of operation is at a low-frequency limit of the second antenna.

In one embodiment, each channel includes a dielectric fill material having a dielectric constant, and the wavelength is the speed of light, divided by the shared frequency of operation, and divided by the square root of the dielectric constant of the dielectric fill material.

In one embodiment, the dielectric constant is greater than 1.

In one embodiment, each channel has a width of less than one quarter of a wavelength corresponding to a shared frequency of operation of the first antenna and the second antenna.

In one embodiment, each channel has a width of less than 0.1 times a wavelength corresponding to a shared frequency of operation of the first antenna and the second antenna.

In one embodiment, the plurality of corrugations includes 50 corrugations.

In one embodiment, the plurality of corrugations includes 230 corrugations.

In one embodiment, the barrier includes a substrate parallel to the surface and supporting a plurality of teeth, each tooth having a first conductive surface and a second conductive surface, the first conductive surface being a conductive wall of the two conductive walls of the channel of a first corrugation of the plurality of corrugations, and the second conductive surface being a conductive wall of the two conductive walls of the channel of a second corrugation, of the plurality of corrugations, adjacent the first corrugation.

In one embodiment, the substrate is conductive, and in electrical contact with each tooth of the plurality of teeth.

In one embodiment, the layer of radar-absorbing material has a thickness of more than 0.020 inches and less than 0.100 inches.

In one embodiment, the radar-absorbing material includes particles of iron.

In one embodiment, the radar-absorbing material includes particles of carbon.

In one embodiment, the barrier extends, in a direction perpendicular to the straight line between the first antenna and the second antenna, a distance that covers a main beam width of the first antenna and a main beam width of the second antenna.

In one embodiment, the distance between the first antenna and the second antenna is greater than 30 inches, and wherein the barrier extends, in the direction perpendicular to the straight line between the first antenna and the second antenna, a distance of at least 15 inches.

In one embodiment, the channel of a corrugation of the plurality of corrugations extends in a first direction, the first direction being parallel to the surface, and an angle between the first direction and the straight line between the first antenna and the second antenna being greater than 30 degrees and less than or equal to 90 degrees.

BRIEF DESCRIPTION OF THE DRAWINGS

Features, aspects, and embodiments are described in conjunction with the attached drawings, in which.

DETAILED DESCRIPTION

The detailed description set forth below in connection with the appended drawings is intended as a description of exemplary embodiments of an isolation barrier provided in accordance with the present invention and is not intended to represent the only forms in which the present invention may be constructed or utilized. The description sets forth the features of the present invention in connection with the illustrated embodiments. It is to be understood, however, that the same or equivalent functions and structures may be accomplished by different embodiments that are also intended to be encompassed within the spirit and scope of the invention. As denoted elsewhere herein, like element numbers are intended to indicate like elements or features.

Co-site interference may cause problems for co-planar arrays or conformal antennas, especially on a platform such as a commercial or military aircraft having limited space for antenna placement. In such a situation, if there is significant electromagnetic coupling, one or more receiving antennas operating simultaneously with transmitting antennas may be victims of co-site interference, especially if the antennas operate in the same frequency band (e.g., if the transmitting antenna and the one or more receiving antennas have one or more shared frequencies of operation). Antenna relocation may be used to reduce the antenna-to-antenna coupling on a platform if space is available. However, this approach may not be feasible on finite size platforms, especially when low-frequency radio frequency (RF) systems are involved. As used herein, the terms "radio frequency" and "RF" include frequencies that may also be referred to as microwaves or millimeter waves, and, in particular, the terms "radio frequency" and "RF" as used herein encompass a frequency range extending from 1 MHz to 300 GHz.

Another approach to mitigating co-site interference involves the use of tunable filters to provide isolation between antenna systems operating at different frequencies. This approach may introduce unwanted losses and may be of limited value when two RF systems, especially wideband or ultra-wideband systems, need to operate within one frequency band or within overlapping frequency bands. Radar absorbing material (RAM) isolation barriers may also be used to reduce antenna-to-antenna coupling on a platform. However, RAM isolation barriers may have limited effectiveness at low frequencies (e.g. frequencies of less than 4 GHz) and may be bulky (i.e., in size and weight), especially for low-frequency applications.

Figure 1:
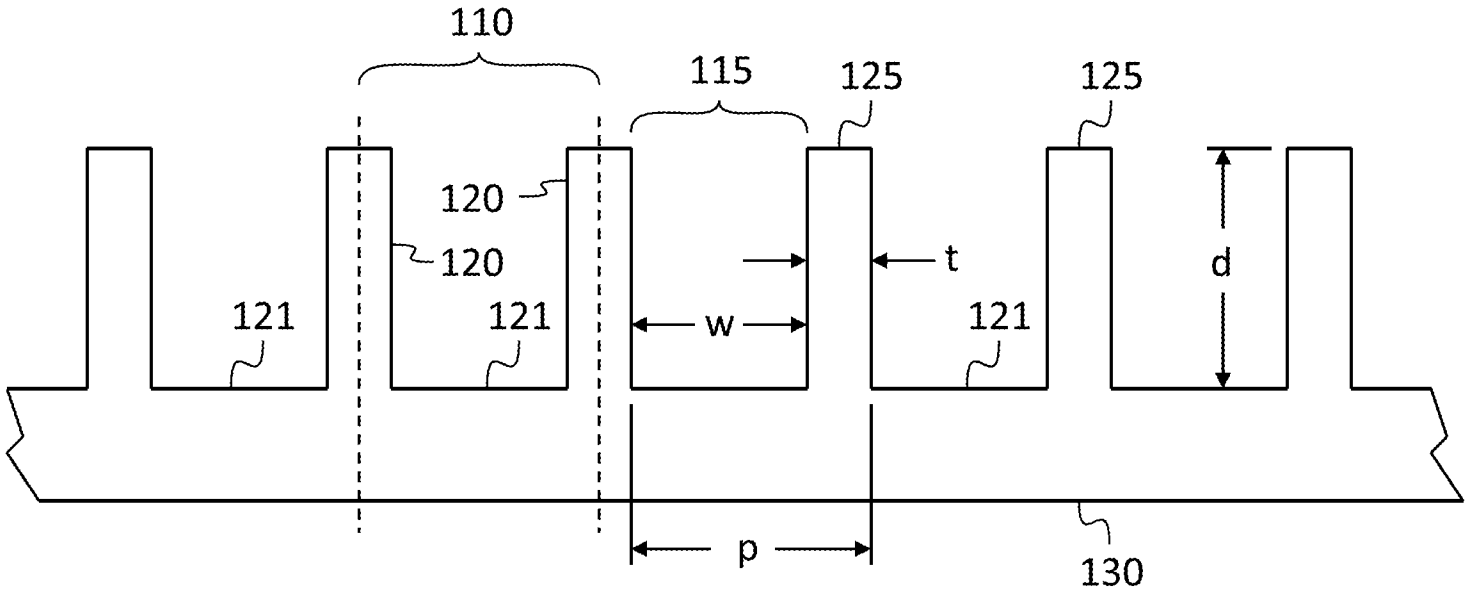
FIG. 1 is a schematic cross-sectional view of a set of corrugations, according to an embodiment of the present invention.
Figure 4:
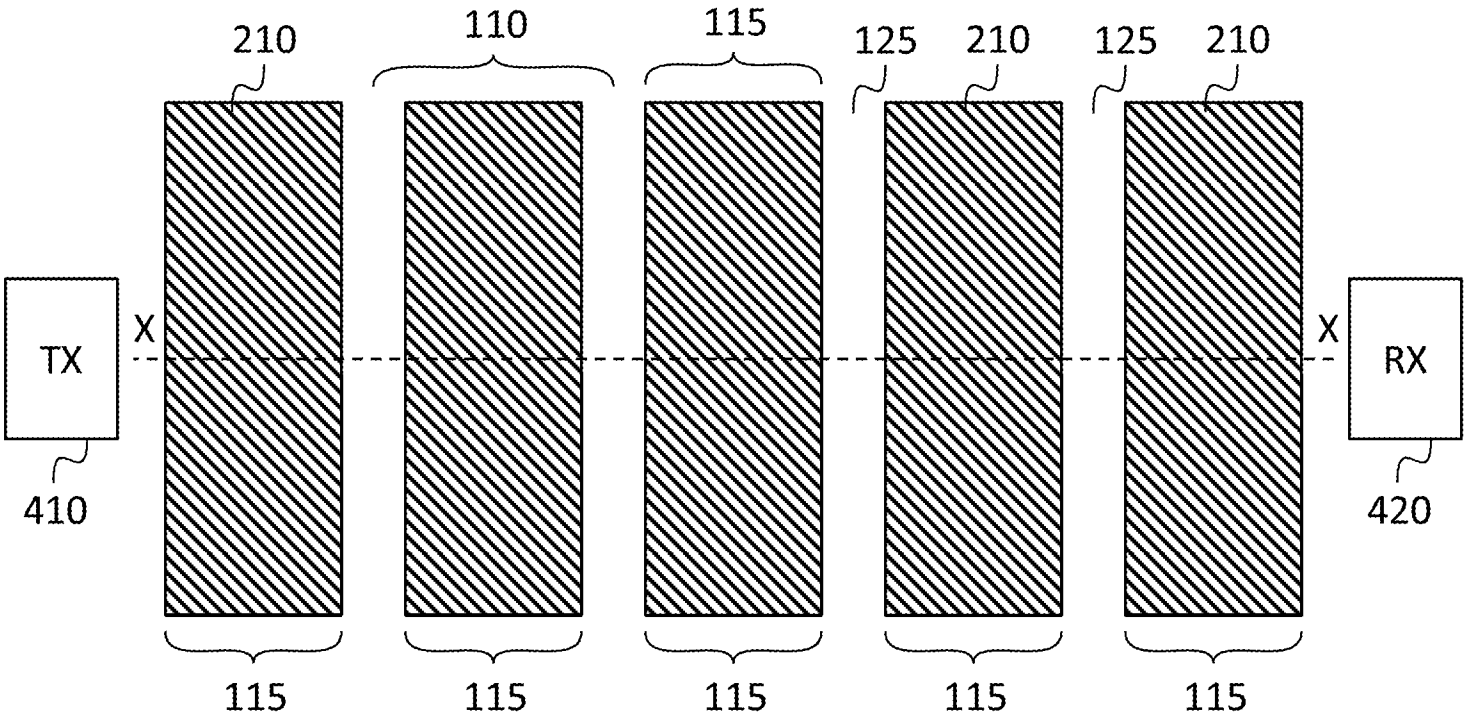
FIG. 4 is a schematic plan view of two antennas on a platform, separated by an isolation barrier, according to an embodiment of the present invention.

Referring to FIG. 1, an isolation barrier for reducing co-site interference, according to some embodiments of the present invention, may include a coupling barrier consisting of a plurality of corrugations 110, each including a channel 115, two conductive walls 120, and a conductive base 121. Each channel may be empty or nearly empty (e.g., filled with air, or containing vacuum) or it may be filled with a dielectric having a dielectric constant significantly greater than 1, as discussed in further detail below. The corrugations may be formed, for example, by a plurality of conductive teeth 125, or "fins" secured to a substrate 130, the top surface of which may form the conductive base 121 of each of the corrugations 110. In some embodiments, the teeth 125 are composed of aluminum, and have a thickness t that is approximately 0.01λ (where λ is the wavelength of electromagnetic waves, in the material filling the channel 115 or in vacuum if the channels contain vacuum), at the operating frequency of the system. In other embodiments, the thickness t of each tooth may be between 0.001λ and 0.1λ, or, in some embodiments, between 0.003λ and 0.03λ. For example, for an operating frequency of 2 GHz, teeth 125 having a thickness of approximately 0.01λ may have a thickness of approximately 0.06 inches. If the channels contain a dielectric with a relative permittivity ε or "dielectric constant" significantly greater than 1, then some of the dimensions, e.g., the width w, the depth d, and the period p, as discussed in further detail below may be reduced in proportion to the reciprocal of the square root of the dielectric constant without significantly changing the behavior of the coupling barrier or the isolation barrier. In the direction perpendicular to the plane of FIG. 1 (e.g., in a direction into or out of the paper), the corrugations 110 may extend a distance that covers the main beam of the transmitting antenna 410 (FIG. 4) and the receiving antenna 420 (FIG. 4).

The depth d of each channel 115 may be at least, or approximately, one quarter wave, i.e., 0.25λ, corresponding, for an operating frequency of 2 GHz to a depth of 1.5 inches if the channels contain air or to a depth of 0.3 inches if the channels contain a dielectric with a relative permittivity ε of 25. In other embodiments, the depth d of each channel may be between 0.25λ and 1.0λ, or, in some embodiments, between 0.25λ and 5λ. The width w of each channel 115 may be less than one quarter wave, e.g., it may be between 0.01λ and 0.25λ, or, in some embodiments, between 0.05λ and 0.25λ. For example, the width w may be approximately 0.09λ, corresponding, for an operating frequency of 2 GHz, to a width w of 0.54 inches if the channels contain air or to width w of 0.108 inches if the channels contain a dielectric with a relative permittivity ε of 25. The period p of the set of corrugations 110 may be the sum of the thickness t of the teeth 125 and the width w of each channel 115. The substrate 130 may be a conductor, conductively connected to the teeth 125, or a conductor not conductively connected to the teeth 125.

Figure 2:
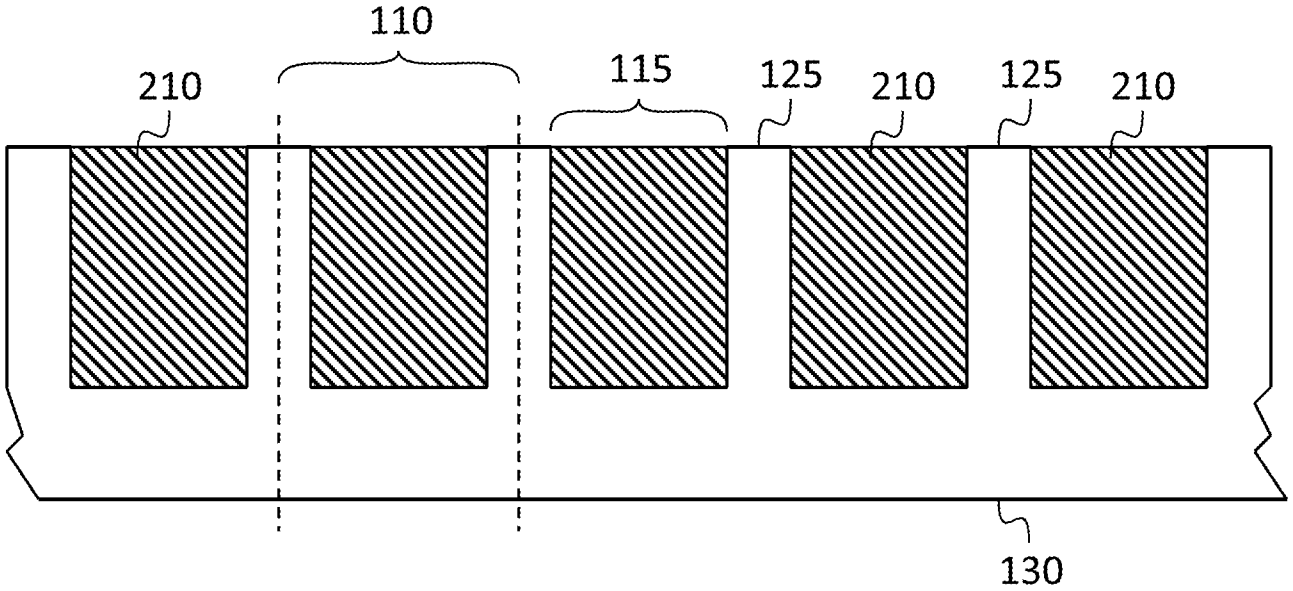
FIG. 2 is a schematic cross-sectional view of a set of corrugations with dielectric fill, according to an embodiment of the present invention.

Referring to FIG. 2, in some embodiments, as mentioned above, each channel may be filled or "loaded" with a dielectric fill 210, e.g., a dielectric fill material other than air, such as a thermoplastic or thermoset polymer, that may have a dielectric constant at the frequency of operation (e.g., at 2.0 GHz) of about 25. As mentioned above, the use of a dielectric fill 210 may make it possible to reduce certain dimensions of the structure without significantly affecting its isolation performance. In some embodiments, the structure may be scaled in proportion to the reciprocal of the square root of the dielectric constant, at the frequency of operation, of the dielectric fill 210.

Figure 3:
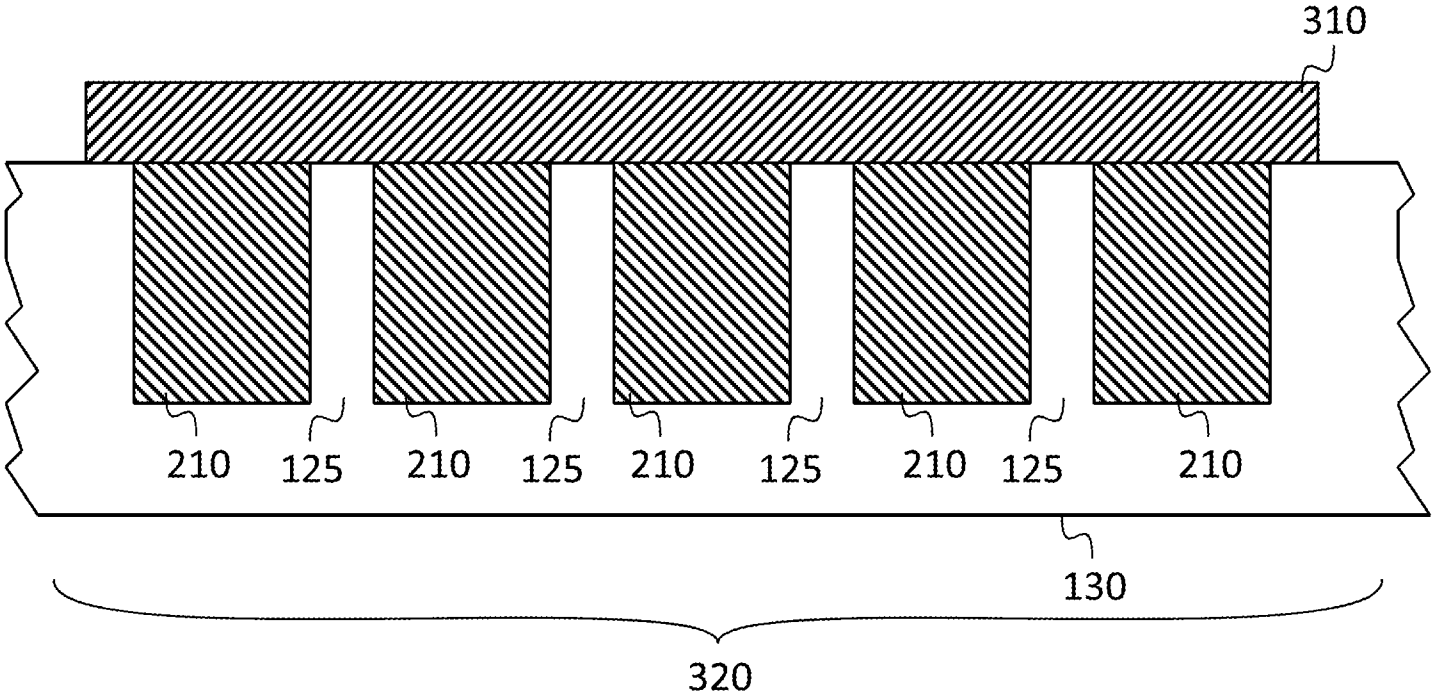
FIG. 3 is a schematic cross-sectional view of an isolation barrier, according to an embodiment of the present invention.

Referring to FIG. 3, in some embodiments, a layer 310 of a radar absorbing material (RAM) may cover coupling barrier including the set of corrugations 110, to form an isolation barrier 320. The radar absorbing material layer 310 may include carbon and iron. In some embodiments it is composed of a rubberized foam material impregnated with a controlled mixture of carbon particles and iron particles. The thickness of the radar absorbing material layer 310 may be selected to be sufficiently great to have a significant effect on electromagnetic waves propagating across its surface or through it at high frequencies (e.g., >4 GHz), and sufficiently small that waves propagating across its surface may interact to a significant degree with the set of corrugations 110 underneath the radar absorbing material layer 310 at low frequencies (e.g., <4 GHz). In some embodiments, a 0.055 inch thick layer of radar absorbing material is used; in some embodiments the radar absorbing materials (RAM) is UI-80. The material referred to by those of skill in the art as UI-80 is 80% by weight iron loaded urethane resin, the "U" of the name "UI-80" identifies the binder as being urethane and the "I" identifies the material as being iron-based. UI-80 is a magnetic radar absorbing material (MagRAM).

UI-80 consists of two components; (1) carbonyl iron powder (CIP), which acts as the absorber, and (2) urethane, which is the binder. UI-80 is mixed to include 80% CIP and 20% urethane by weight. In other embodiments these components are combined in other ratios. In some embodiments the radar absorbing material layer 310 is composed instead of UI-70 or UI-60. Other binders, such as silicone may be used instead of urethane; SI-80 is a material with this composition. In some embodiments, a radar absorbing material that is carbon based rather than iron based is used. Such a material may be referred to as a material of the SL series (e.g., SL-24, or SL); it may lack the magnetic component but may be lighter weight.

Other types of MagRAM include silicone resin based SI-80 and epoxy based EI-80, etc. MagRAM sheets are thin, flexible absorbers. The thickness of a MagRAM sheet used to form the radar absorbing material layer 310 may be limited by weight requirements (e.g., to thicknesses less than 0.060"). FIG. 3 shows a radar absorbing material layer 310 covering a set of five corrugations 110; in other embodiments the isolation barrier 320 may include fewer or more corrugations 110, e.g., it may include 230 or more corrugations 110. The number of corrugations (i.e., the length of the corrugated surface) may be selected according to the desired isolation levels. In some embodiments, the isolation level is proportional to the length of the corrugated surface.

An isolation barrier 320 such as that illustrated in FIG. 3 may be installed, for example, in the surface or "skin" of an aircraft, such that the top of radar absorbing material layer 310 is flush with the skin of the aircraft, or such that the top of the corrugations 110 is flush with the skin of the aircraft. The aircraft may also have a transmitting antenna 410 recessed below the skin of the aircraft (e.g., behind a radome having an outer surface flush with the skin of the aircraft) on one side of the isolation barrier 320 and a receiving antenna 420 recessed below the skin of the aircraft on the other side of the isolation barrier 320. The channels 115 and teeth 125 may extend in a direction substantially perpendicular to a straight line X-X connecting the transmitting antenna 410 and the receiving antenna 420. In some embodiments the channels 115 and teeth 125 may extend in a direction that is instead oblique to the straight line X-X. In some embodiments the angle between the line X-X and the channels 115 and teeth 125 is between 45 degrees and 89 degrees.

Figure 5:
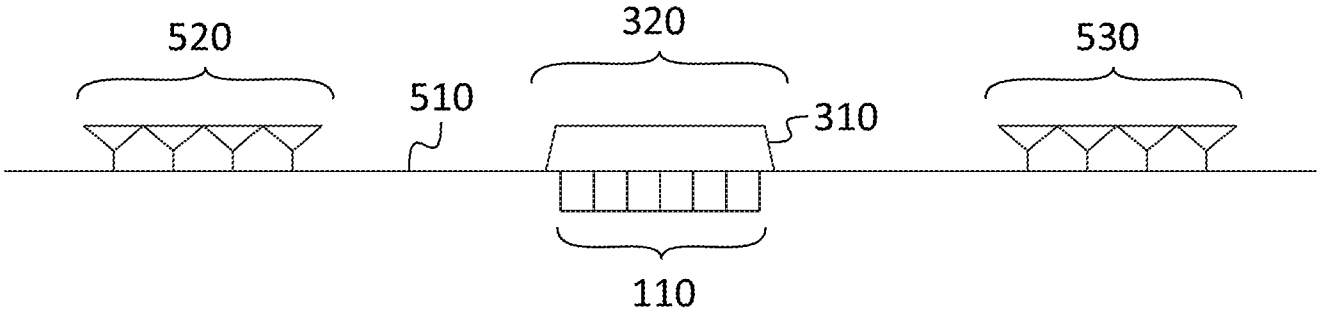
FIG. 5 is a schematic side view of two array antennas on a platform, separated by an isolation barrier, according to an embodiment of the present invention.

Referring to FIG. 5, in some embodiments, an isolation barrier 320 may be used on (and partially embedded in) a surface 510 of a platform, between a first array antenna 520 (e.g., a transmitting antenna) and a second array antenna 530 (e.g., a receiving antenna). The radar absorbing material layer 310 of the isolation barrier 320 may have a shape that is trapezoidal in cross section for a smooth transition to the RAM, as shown in FIG. 5.

Example 1

A demonstration unit of an integrated isolation barrier was fabricated and tested. Four different configurations were tested: a configuration in which the test surface is covered with a sheet 610 of a near perfect electric conductor (a sheet of aluminum) (FIG. 6A); a configuration in which the test surface is covered with a radar absorbing material layer 310 on a sheet of a near perfect electric conductor (FIG. 6B); a configuration in which a portion of the test surface is covered with a sheet 610 of a near perfect electric conductor and the remainder of the surface has embedded in it a set of corrugations 110 (FIG. 6C); and a configuration in which a portion of the test surface is covered with a sheet 610 of a near perfect electric conductor and the remainder of the surface has embedded in it a set of corrugations 110, and a radar absorbing material layer 310 covers both the set of corrugations 110 and the sheet 610 of the near perfect electric conductor (FIG. 6D).

A transmitting antenna 410 and a receiving antenna 420 were set up on two respective sides of the test setup and the isolation between the transmitting antenna and the receiving antenna was measured, as a function of frequency, for each of the four configurations. The results are shown in the graph of FIG. 7.

Figures 6A, 6B, 6C, 6D:
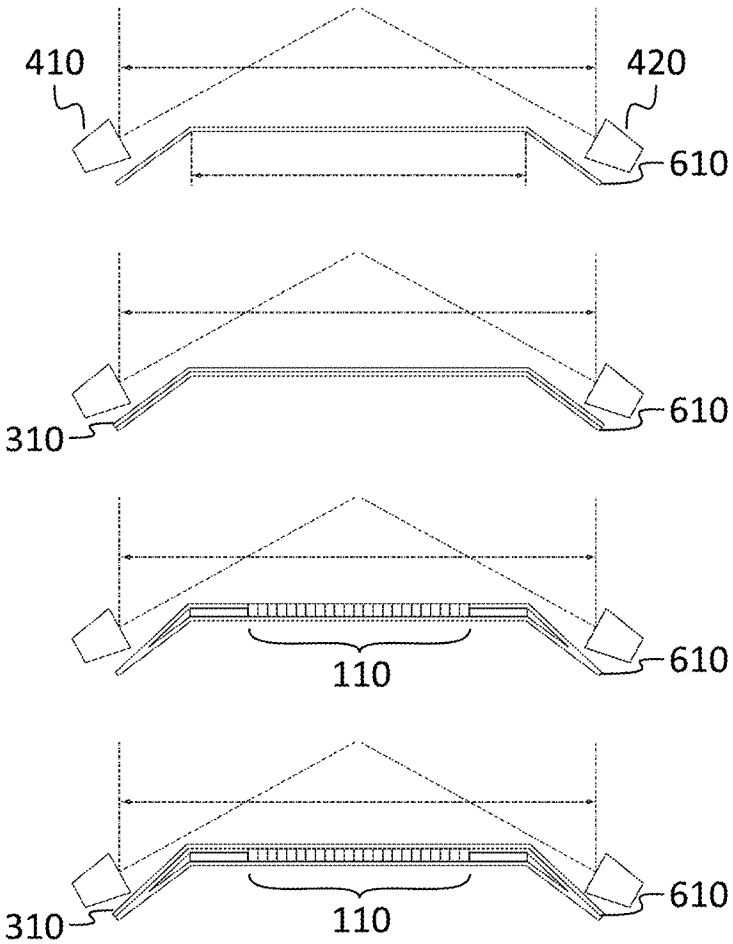
FIG. 6A is a cross-sectional view of a test setup, according to an embodiment of the present invention.
FIG. 6B is a cross-sectional view of a test setup, according to an embodiment of the present invention.
FIG. 6C is a cross-sectional view of a test setup, according to an embodiment of the present invention.
FIG. 6D is a cross-sectional view of a test setup, according to an embodiment of the present invention.

A first curve 710 (labeled "PEC" in the legend of FIG. 7) shows the isolation values measured for the configuration in which the test surface is covered with a sheet of a near perfect electric conductor as shown in FIG. 6A. A second curve 720 (labeled "RAM Only" in the legend of FIG. 7) shows the isolation values measured for the configuration in which the test surface is covered with a radar absorbing material layer 310 on a sheet of a near perfect electric conductor as shown in FIG. 6B. A third curve 730 (labeled "CB only" in the legend of FIG. 7) shows the isolation values measured for the configuration in which a portion of the test surface is covered with a sheet 610 of a near perfect electric conductor and the remainder of the surface has embedded in it a set of corrugations 110 as shown in FIG. 6C. A fourth curve 740 (labeled "RAM-ON-CB" in the legend of FIG. 7) shows the isolation values measured for the configuration in which a portion of the test surface is covered with a sheet 610 of a near perfect electric conductor and the remainder of the surface has embedded in it a set of corrugations 110, and a radar absorbing material layer 310 covers both the set of corrugations 110 and the sheet 610 of the near perfect electric conductor as shown in FIG. 6D.

Figure 7:
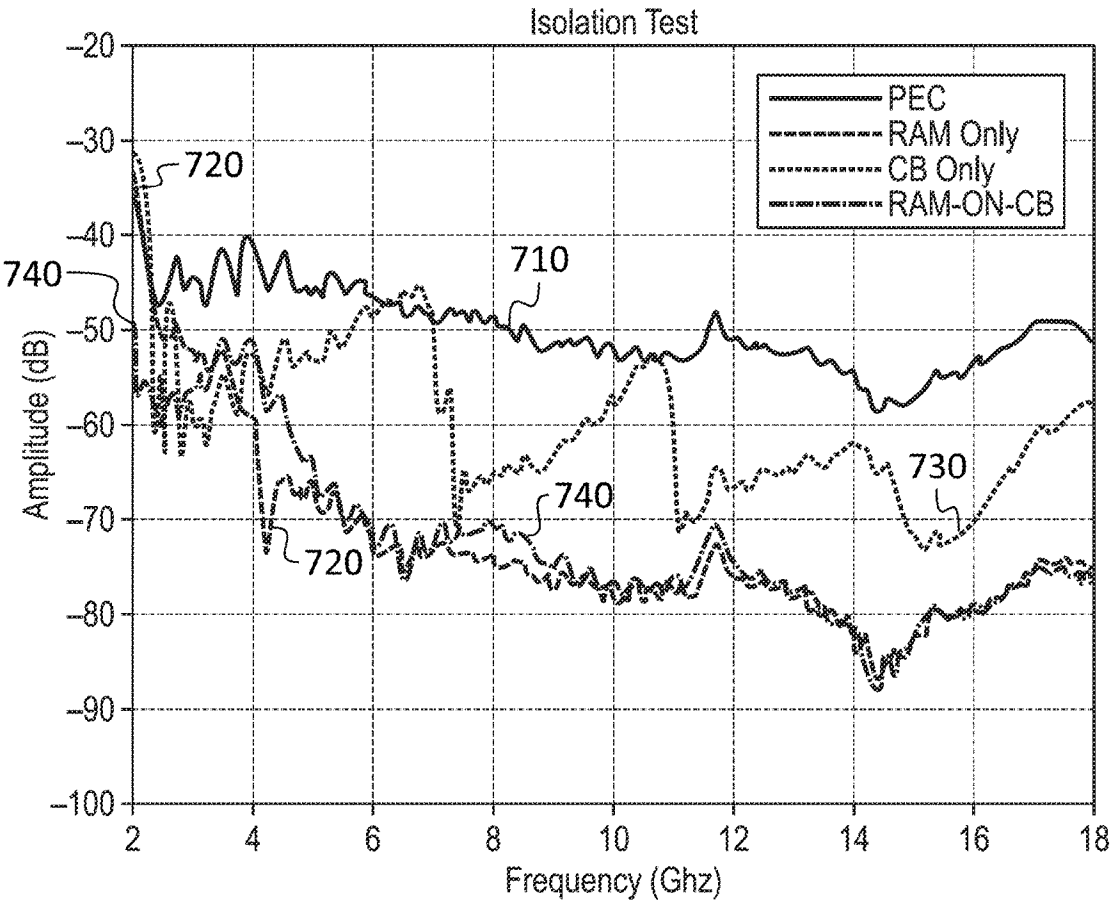
FIG. 7 is a graph of measured isolation values as a function of frequency, according to an embodiment of the present invention.

It may be seen from FIG. 7 (in particular from the first curve 710 and the second curve 720), that the presence of only a radar absorbing material layer 310 on a conductive surface attenuates the transmission of electromagnetic radiation from the transmitting antenna 410 to the receiving antenna 420 by about 20 dB over a frequency range extending from about 4 GHz to about 18 GHz. At low frequencies, however, (e.g., at frequencies below about 4 GHz), the attenuation provided by this configuration decreases rapidly, and below about 2.5 GHz, this configuration provides little attenuation of the transmission of electromagnetic radiation from the transmitting antenna 410 to the receiving antenna 420. The measured isolation data show that a simple RAM layer without underlying corrugations becomes ineffective in the low frequency region (i.e., <4 GHz).

It may be seen from the third curve 730 that the presence of the set of corrugations 110 also significantly attenuates the transmission of electromagnetic radiation from the transmitting antenna 410 to the receiving antenna 420 at some frequencies (e.g., at about 2.4 GHz, at about 7.3 GHz, at about 11.5 GHz, and at about 15.6 GHz). At other frequencies, however, the configuration in which a portion of the test surface is covered with a sheet 610 of a near perfect electric conductor, and the remainder of the surface has embedded in it a set of corrugations 110, shows relatively little attenuation of the transmission of electromagnetic radiation from the transmitting antenna 410 to the receiving antenna 420.

Referring to the fourth curve 740, the configuration in which a portion of the test surface is covered with a sheet 610 of a near perfect electric conductor and the remainder of the surface has embedded in it a set of corrugations 110 provides attenuation of electromagnetic radiation, from the transmitting antenna 410 to the receiving antenna 420, exceeding about 20 dB at all frequencies between 4.5 GHz and 18 GHz. At frequencies below about 3.3 GHz it outperforms the configuration in which the test surface is covered with a radar absorbing material layer 310 on a sheet of a near perfect electric conductor. In particular, at frequencies below about 2.4 GHz it shows attenuation of about 15 dB or more compared to the RAM case, even though over this frequency range either element alone (either the set of corrugations 110 alone, or the radar absorbing material layer 310 alone) produces little if any attenuation.

Table 1 below shows, in the third column (entitled "Dielectric (ε=25)") the parameters of the set of corrugations 110 employed in the configurations of FIGS. 6C and 6D (and which yielded the measured isolation shown in the third curve 730 and in the fourth curve 740 of FIG. 7, respectively). In Table 1, n is the number of corrugations 110 in the set of corrugations 110, and w, t, d, and p have the meanings illustrated in FIG. 1. L is the total length of the set of corrugations 110 (i.e., it is equal to n times p) and W is the width of the isolation barrier 320 in a direction parallel to the surface of the platform and perpendicular to a line joining the transmitting antenna 410 and the receiving antenna 420.

The column entitled "Air" shows a hypothetical second configuration expected to show similar behavior to the configuration corresponding to the column entitled "Dielectric (ε=25)". In the column entitled "Air", the dimensions are adjusted in proportion to the longer wavelength that electromagnetic waves may have when the dielectric material is air instead of a material with a dielectric constant of 25.

TABLE 1

| Quantity | Air | Dielectric (ε = 25) | Units |
|---|---|---|---|
| n | 230 | 230 | |
| w | 0.09 | 0.09 | λ |
| | 0.54 | 0.108 | inches |
| t | 0.01 | 0.01 | λ |
| | 0.06 | 0.012 | inches |
| d | 0.25 | 0.25 | λ |
| | 1.5 | 0.3 | inches |

TABLE 1-continued

| Quantity | Air | Dielectric (ε = 25) | Units |
|---|---|---|---|
| p | 0.1 | 0.1 | λ |
| | 0.6 | 0.12 | inches |
| L | 138 | 27.6 | inches |
| W | 24 | 24 | inches |

Although limited embodiments of an isolation barrier have been specifically described and illustrated herein, many modifications and variations will be apparent to those skilled in the art. Accordingly, it is to be understood that an isolation barrier employed according to principles of this invention may be embodied other than as specifically described herein. The invention is also defined in the following claims, and equivalents thereof.

What is claimed is:

1. A barrier for isolating a first antenna on a surface of a platform from a second antenna on the surface, the barrier comprising:

a plurality of corrugations, each corrugation comprising a channel having two conductive walls and a conductive base, the channel and its walls extending continuously in a direction parallel to the surface and perpendicular or oblique to a straight line between the first antenna and the second antenna; and a layer of a radar-absorbing material parallel to and extending across a plurality of the corrugations.

2. The barrier of claim 1, wherein each corrugation has a depth of at least one quarter of a wavelength corresponding to a shared frequency of operation of the first antenna and the second antenna.

3. The barrier of claim 2, wherein the shared frequency of operation is at a low-frequency limit of the first antenna.

4. The barrier of claim 3, wherein the shared frequency of operation is at a low-frequency limit of the second antenna.

5. The barrier of claim 2, wherein each channel includes a dielectric fill material having a dielectric constant, and the wavelength is the speed of light, divided by the shared frequency of operation, and divided by the square root of the dielectric constant of the dielectric fill material.

6. The barrier of claim 5, wherein the dielectric constant is greater than 1.

7. The barrier of claim 1, wherein each channel has a width of less than 0.09 times a wavelength corresponding to a shared frequency of operation of the first antenna and the second antenna.

8. The barrier of claim 1, wherein the plurality of corrugations comprises 50 corrugations.

9. The barrier of claim 8, wherein the plurality of corrugations comprises 230 corrugations.

10. The barrier of claim 1, further comprising a substrate parallel to the surface and supporting a plurality of teeth, each tooth having a first conductive surface and a second conductive surface, the first conductive surface being a conductive wall of the two conductive walls of the channel of a first corrugation of the plurality of corrugations, and the second conductive surface being a conductive wall of the two conductive walls of the channel of a second corrugation, of the plurality of corrugations, adjacent the first corrugation.

11. The barrier of claim 10, wherein the substrate is conductive, and in electrical contact with each tooth of the plurality of teeth.

12. The barrier of claim 1, wherein the layer of radar-absorbing material has a thickness of more than 0.020 inches and less than 0.100 inches.

13. The barrier of claim 1, wherein the radar-absorbing material comprises particles of iron.

14. The barrier of claim 1, wherein the radar-absorbing material comprises particles of carbon.

15. The barrier of claim 1, wherein the barrier extends, in a direction perpendicular to the straight line between the first antenna and the second antenna, a distance that covers a main beam width of the first antenna and a main beam width of the second antenna.

16. The barrier of claim 15, wherein the distance between the first antenna and the second antenna is greater than 30 inches, and wherein the barrier extends, in the direction perpendicular to the straight line between the first antenna and the second antenna, a distance of at least 15 inches.

17. The barrier of claim 1, wherein the channel of a corrugation of the plurality of corrugations extends in a first direction, the first direction being parallel to the surface, and an angle between the first direction and the straight line between the first antenna and the second antenna being greater than 30 degrees and less than or equal to 90 degrees.

* * * * *